US005859575A

United States Patent [19]

Hino

[11] Patent Number: 5,859,575

[45] Date of Patent: Jan. 12, 1999

[54] DIELECTRIC FILTER

[75] Inventor: Seigo Hino, Nagoya, Japan

[73] Assignee: NGK Spark Plug Co., Ltd., Nagoya, Japan

[21] Appl. No.: 917,505

[22] Filed: Aug. 26, 1997

[30] Foreign Application Priority Data

Aug. 30, 1996 [JP] Japan ..... 8-230175
Jul. 22, 1997 [JP] Japan ..... 9-196080

[51] Int. Cl.[6] ..... H01P 1/205

[52] U.S. Cl. ..... 333/206; 333/207

[58] Field of Search ..... 333/202, 206, 333/207, 222, 223, 235

[56] References Cited

U.S. PATENT DOCUMENTS 4,464,640 8/1984 Nishikawa et al. ..... 333/203 X
5,436,602 7/1995 McVeety et al. ..... 333/206

FOREIGN PATENT DOCUMENTS 3-89602 4/1991 Japan ..... 333/206

*Primary Examiner*—Seungsook Ham
*Attorney, Agent, or Firm*—Larson & Taylor

[57] ABSTRACT

In a dielectric filter comprising a dielectric block provided with a plurality of through holes bored from the top all the way to the bottom thereof and arranged in parallel with each other, the peripheral walls of the through holes being coated with an inner conductor to produce so many dielectric coaxial resonators, a non-short-circuiting section is formed on the top of the dielectric block, by cutting out at least one of the edges of the top running in parallel with the direction of linking the resonators. With this arrangement, an inter-stage coupling section can be formed accurately and easily regardless in the dielectric filter if a number of dielectric filters being manufactured on a mass production basis show positional displacements and/or dimensional deviations from the specified values in the manufacturing process.

7 Claims, 7 Drawing Sheets

DIELECTRIC FILTER

BACKGROUND OF THE INVENTION

1. Field of the Invention

The present invention relates to a dielectric filter comprising a plurality of dielectric coaxial resonators arranged in parallel.

2. Prior Art

There are known dielectric filters of the type comprising a rectangularly parallelepipedic dielectric block provided with a plurality of through holes bored from the top all the way to the bottom thereof, the peripheral walls of the through holes being coated with an inner conductor to produce so many dielectric coaxial resonators, an outer conductor arranged on a substantial portion of the outer peripheral surface of the dielectric block and a short-circuiting conductor arranged on the surface of the top of the dielectric block and connecting the outer conductor on the outer peripheral surface and the inner conductors on the peripheral walls of the through holes to make it a short-circuiting side, the bottom of the dielectric block being left as an open-circut end. Such dielectric filters can suitably be used as high frequency band filters.

FIG. 1 of the accompanying drawings shows a conventional dielectric filter comprising a rectangularly parallelepipedic dielectric block A which has a short-circuiting end surface B and is provided with paired resonators C, wherein there is provided a region D free from the short-circuiting conductor on the top of the dielectric block A, or the short-circuiting end surface B, between the paired resonators C as interstage coupling means of the resonators (see Japanese Patent Kokai No. 3-293802).

Japanese Patent Kokai No. 8-8607 filed by the applicant of the present patent application discloses a further conventional dielectric filter for a high frequency band. In this conventional dielectric filter, as illustrated in FIG. 2, a dielectric block 1 is provided with a pair of through holes 2*a* and 2*b* arranged in parallel with each other, the peripheral walls of the through holes 2*a* and 2*b* are coated with respective inner conductors 3*a* and 3*b* to produce so many dielectric coaxial resonators. An outer conductor 4 is arranged on a predetermined area of the outer peripheral surface of the dielectric block 1, and a short-circuiting conductor 5 is arranged on the surface of the bottom of the dielectric block 1 for connecting the inner conductors 3*a* and 3*b* with the outer conductor 4 to make it a short-circuiting side. The top of the dielectric block 1 is left as an open-circuit end 6. Further, a slot 7 is formed by removing the outer conductor 4 in a straight and narrow zone on the outer peripheral surface located close to the short-circuiting conductor 5 and running in a direction perpendicular to the through holes 2*a*, 2*b*. An input/output terminals denoted by 8*a* and 8*b* are provided on the outer peripheral surface located close to the open-circuiting end surface 6 of the dielectric block 1.

With such an arrangement, the dielectric coaxial resonators can be coupled with each other and polarized easily and simultaneously.

Of known dielectric filters for high frequencies of the type under consideration, the one having a region, or slot, free from a short-circuit conductor on the short-circuiting side of the dielectric block for coupling each other as shown in FIG. 1 is required to make the slot show a large width and a surface area equal to about two thirds of the total surface area of the short-circuiting side in order to couple the resonators sufficiently at the cost of reducing the value of Q.

Additionally, the overall mechanical strength of the dielectric filter can be reduced if the coupling slot is formed by cutting the dielectric block at the short-circuiting side between the resonators.

On the other hand, the one an shown in FIG. 2 is typically covered with a shield casing after mounting the dielectric filter on the surface of a printed circuit board not shown and connecting the input/output terminals 8*a* and 8*b* formed on the lateral side of the dielectric block 1 opposite to the lateral side where the coupling slot 7 is formed directly to the printed circuit, said former lateral side being the under side of the dielectric block 1 with this mounting arrangement. Then, the inner wall surface of the shield casing has to be separated from the coupling slot 7 on the upper side of the dielectric block 1, or the lateral side where the coupling slot 7 is formed, by at least 3 mm because the degree of coupling can be altered if the inner wall surface of the shield casing comes closer to or into contact with the coupling slot 7 on the upper side of the dielectric block 1. In other words, this dielectric filter is not adapted to height reduction commonly required to dielectric filters of the type under consideration.

Additionally, when manufacturing dielectric filters for a high frequency band of the type under consideration, a number of devices (e.g., 20 to 30 devices) are pinched together by a set of jigs and silver paste is applied thereto to form a conductor layer on each of the devices for the purpose of mass production.

Then, a dielectric filter having a configuration as illustrated in FIG. 2 is accompanied by the problem that the stencil for producing a coupling slot thereon cannot be arranged accurately in position when the filter devices pinched by the jigs show positional displacements and/or dimensional deviations from the specified values, if slight.

In view of these and other problems, it is therefore an object of the present invention to provide a dielectric filter having a short-circuiting surface on which a coupling element can be precisely positioned without requiring any accurate patterning operation and capable of providing a sufficient degree of coupling without reducing the Q value and meeting the requirement of height reduction.

SUMMARY OF THE INVENTION

According to the invention, the above object is achieved by providing a dielectric filter comprising a dielectric block provided with a plurality of through holes bored from the top all the way to the bottom thereof and arranged in parallel with each other, a peripheral wall of each of the through holes being coated with an inner conductor to produce so many dielectric coaxial resonators, an outer conductor arranged on a substantial portion of the outer peripheral surface of the dielectric block and a short-circuiting conductor arranged on the surface of the top of the dielectric block and connecting the inner conductors on the peripheral walls of the through holes with the outer conductor on the outer peripheral surface to make it a short-circuiting side, the bottom of the dielectric block being left as an open end, wherein at least one non-short-circuiting section is provided on the top, or the short-circuiting side of the dielectric block, each of which is formed by cutting out at least one of the edges of the top running in parallel with the direction of linking the resonators.

Preferably, each non-short-circuiting section may be formed as a stepped section arranged along one of the edges of the short-circuiting side of the dielectric block running in parallel with the direction of linking the resonators.

Alternatively, each non-short-circuting section may be formed as a beveled section arranged along one of the edges of the short-circuiting side of the dielectric block running in parallel with the direction of linking the resonators.

Preferably, each non-short-circuiting section may be arranged along one of the edges and extends all the way between the opposite ends of the edge.

Furthermore, the non-short-circuiting section may have a width w which is a range of 0.2 mm<w<1.2 mm, preferably about 0.7 mm.

The characteristic values of the filter according to the present invention can be regulated by controlling the area of said each non-short-circuiting section.

With a dielectric filter for a high frequency band according to the invention and having a configuration as described above, no patterning operation has to be conducted on a narrow region of the short-circuiting side of the dielectric block and the non-short-circuiting section can be formed as a stepped section or a beveled section on the filter device quickly in a simply manner even if silver paste has been applied on the entire outer peripheral surface of the dielectric block.

From the functional point of view, the dielectric coaxial resonators formed in the respective through holes are electrostatically coupled on the bottom, or the open-circuiting end, of the dielectric block and magnetically coupled on the top, or the short-circuiting side, of the dielectric block. Thus, the magnetic field is made hardly escapable toward the outer conductor and the magnetic coupling is intensified by the non-short-circuiting section formed along one of the edges of the short-circuiting side of the dielectric block running in parallel with the direction of linking the resonators. Consequently, the magnetic coupling surpasses the electrostatic coupling as a whole and hence any adjacent resonators are magnetically coupled to provide an interstage coupling.

A dicing saw may be used to cut an edge of the dielectric block to produce a stepped or beveled profile for a non-short-circuiting section. Such a stepped or beveled section may be formed at the time of producing a dielectric block by means of a press. A short-circuiting side may be formed by applying an electroconductive material such as silver paste to the top of the dielectric block except the non-short-circuiting section.

Alternatively, a non-short-circuiting may be produced by cutting out an edge of the top of the dielectric block after applying a short-circuiting electroconductive material thereto to prepare a short-circuiting side.

DETAILED DESCRIPTION OF THE PREFERRED EMBODIMENTS

Now, the present invention will be described by referring to FIGS. 3 through 9 of the accompanying drawings that illustrate preferred embodiments of the invention.

Figure 3:
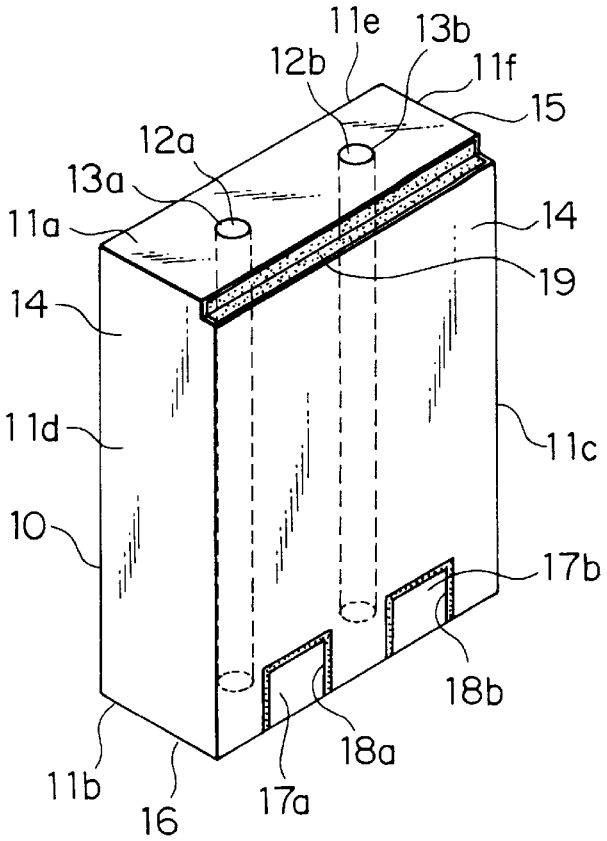
FIG. 3 is a schematic perspective view showing an embodiment of two-stage type dielectric filter for a high frequency band according to the invention.
Figure 4:
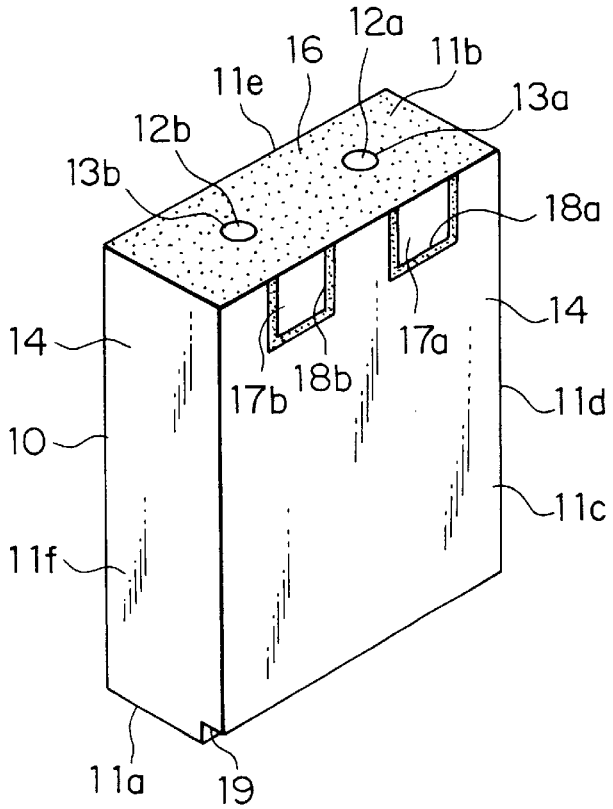
FIG. 4 is a schematic perspective view taken from the bottom of the two-stage type dielectric filter shown in FIG. 3.

FIGS. 3 and 4 are an embodiment of two-stage dielectric filter for a high frequency band obtained by forming a pair of dielectric coaxial resonators in a single dielectric block 10.

The dielectric block 10 is made of a titanium oxide type ceramic dielectric material and has a rectangularly parallelpipedic profile with a top 11*a*, a bottom 11*b* and four lateral sides 11*c*, 11*d*, 11*e* and 11*f*. A pair of through holes 12*a* and 12*b* are bored through the dielectric block 10 all the way from the top 11*a* to the bottom 11*b* and arranged in parallel with each other. The inner peripheral walls of the through holes 12*a* and 12*b* are coated with a conductive material to form a pair of inner conductors 13*a* and 13*b* of respective dielectric coaxial resonators. The outer lateral sides 11*c*, 11*d*, 11*e* and 11*f* of the dielectric block 10 are also coated with a conductive material to produce an outer conductor 14 that operates as a grounding conductor. A short-circuiting conductor 15 is arranged on the top 11*a* of the dielectric block 10 as an extension of the outer conductor 14 and connects the inner conductors 13*a* and 13*b* of the dielectric coaxial resonators to the outer conductor 14. The bottom 11*b* of the dielectric block 10 is left as an open-circuiting end 16.

A pair of input/output conductors 17*a* and 17*b* are formed on one of the lateral sides, or the lateral side 11*c*, and insulated from the outer conductor 14 by means of spacings 18*a* and 18*b*, respectively. One of the input/output conductors, or the input/output conductor 17*a* is capacitively connected to the inner conductor 13*a* by way of the dielectric block 10, whereas the other input/output conductor 17*b* is capacitively connected to the inner conductor 13*b* also by way of the dielectric block 10. One of the input/output conductors 17*a* and 17*b* is connected to the input terminal not shown of a given electric path while the other is connected to the output terminal not shown of the electric path to complete the electric connection of the dielectric filter for a high frequency band.

The principal feature of the dielectric filter according to the invention and having a configuration as described will be described hereinafter.

Referring to FIG. 3, the short-circuiting side 15 of the dielectric block 10 is provided an edge thereof with a stepped section 19, or a non-short-circuiting section, running in parallel with the direction of linking the resonators. This stepped section 19 is formed by cutting out the dielectric block 1 by means of an appropriate cutting means such as a dicing saw, a laser trimmer or a sand blast before the short-circuiting conductor is formed on the top of the dielectric block 10.

Alternatively, the stepped section 19 may be formed at the time of producing the dielectric block 10

Figure 5:
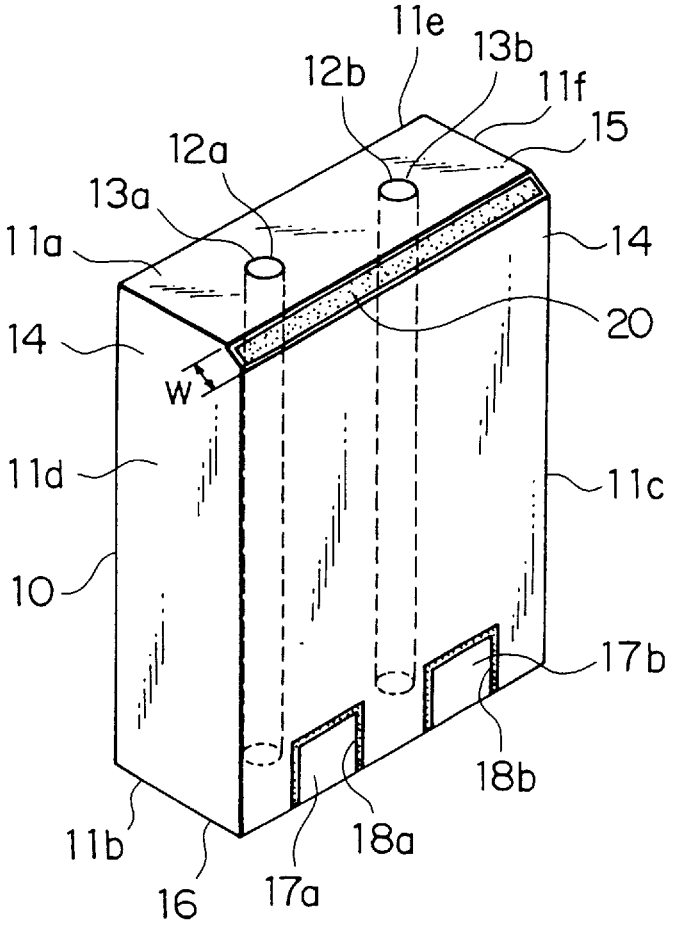
FIG. 5 is a schematic perspective view showing another embodiment of two-stage type dielectric filter for a high frequency band according to the invention.

FIG. 5 illustrates another embodiment of the invention having an alternative non-short-circuiting section. In FIG. 5, the components corresponding to the respective components of the dielectric filter of FIGS. 3 and 4 are denoted respectively by the same reference symbols.

In the embodiment of FIG. 5, the short-circuiting side 15 of the dielectric block 10 provided with a beveled section 20 which is a non-short-circuiting section and formed before the short-circuiting conductor is formed on the top 11*a* of the dielectric block 10 or, alternatively at the time of producing the dielectric block 10.

Figure 1:
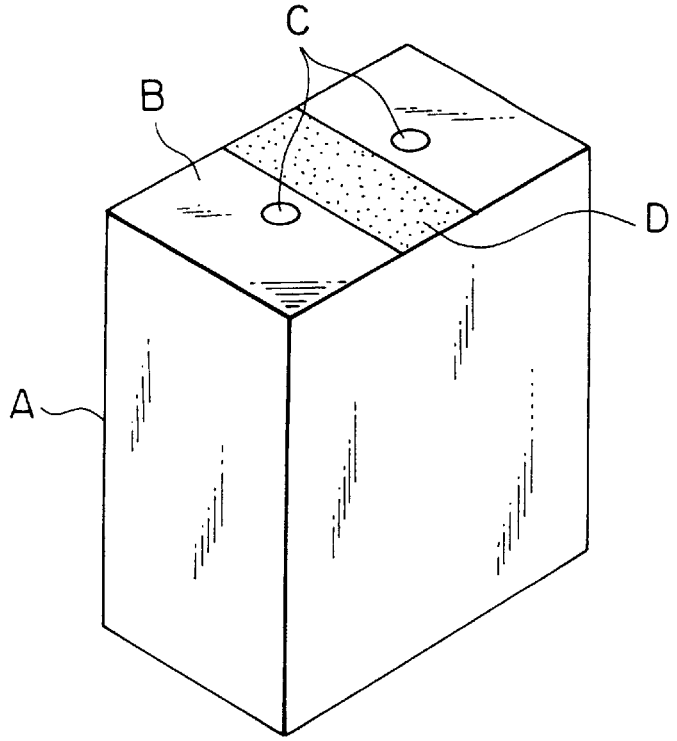
FIG. 1 PRIOR ART
FIG. 1 is a schematic perspective view showing a conventional dielectric filter.
Figure 2:
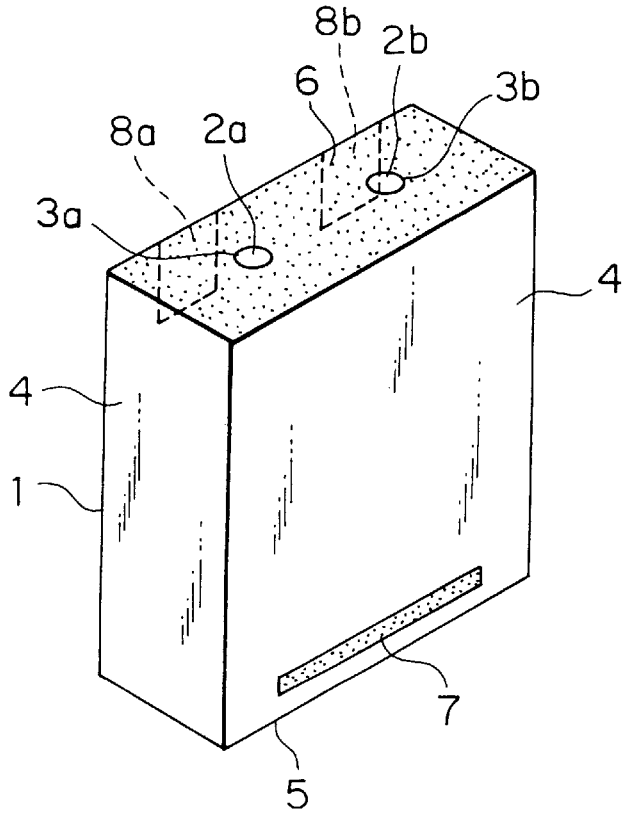
FIG. 2 PRIOR ART
FIG. 2 is a schematic perspective view showing a conventional dielectric filter proposed by the applicant of the present patent application.

In a series of experiments, the performance of each of the embodiments of dielectric filters according to the invention was compared with that of a conventional dielectric filter as shown in FIG. 1. As a result, the illustrated embodiments showed a satisfactory coupling effect regardless of the relatively small areas of the non-short-circuiting sections 19 and 20, whereas it was necessary to remove the short-circuiting conductor of the conventional dielectric filter by approximately two thirds to make it operate as effectively as the embodiments. Consequently, it was difficult for the conventional dielectric filter to be appropriately regulated and a reduced Q value was inevitable to it.

Figure 6:
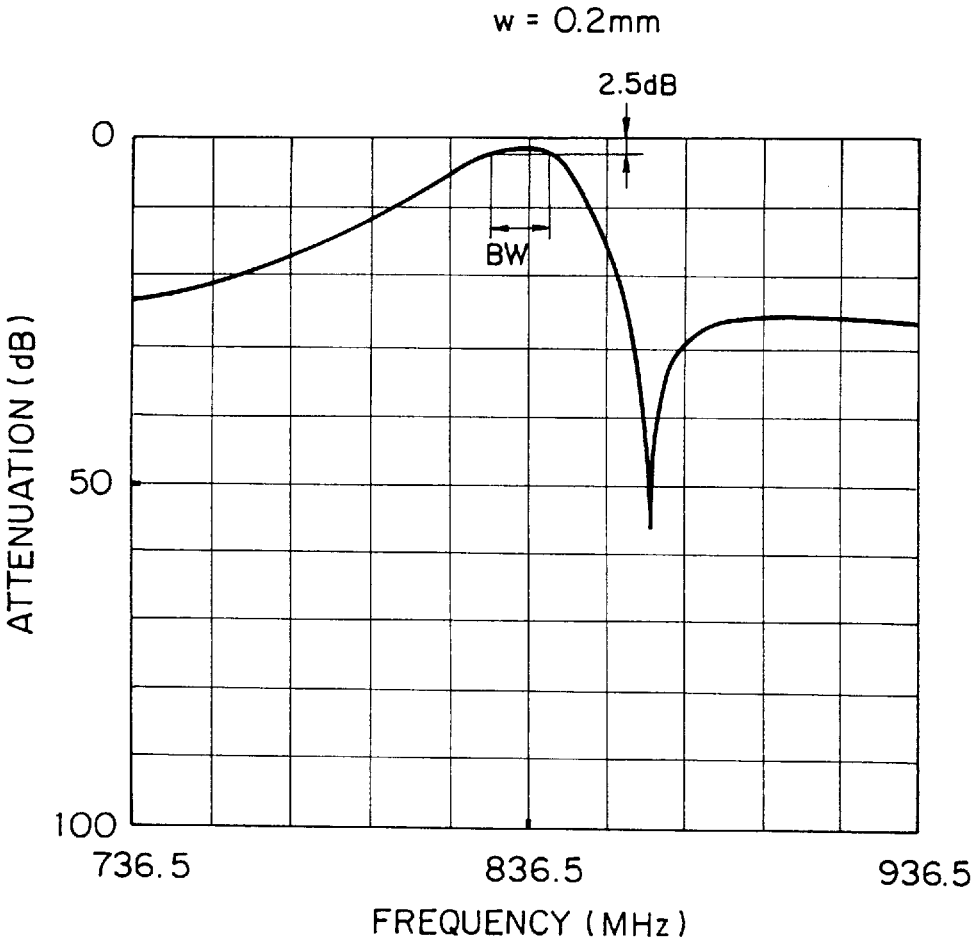
FIG. 6 is a graph showing a frequency characteristic of the filter illustrated in FIG. 5 when a non-short-circuiting section has a width w of 0.2 mm.
Figure 7:
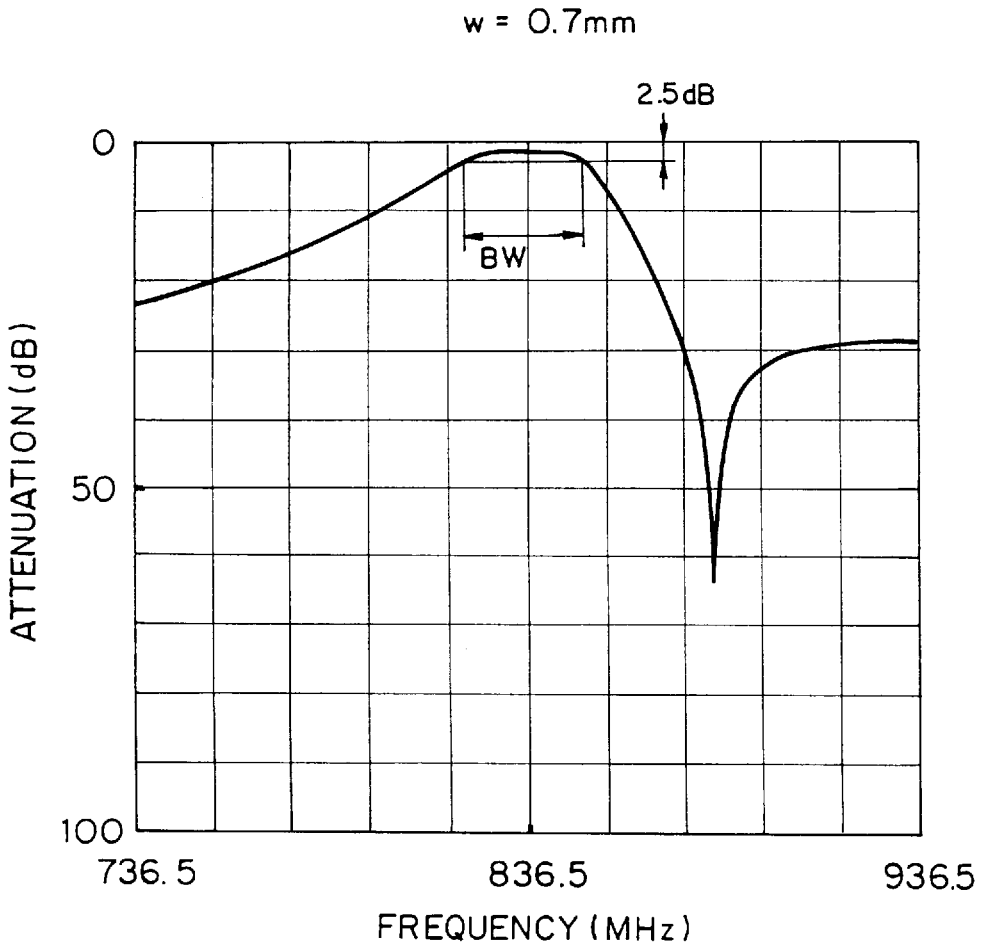
FIG. 7 is a graph showing a frequency characteristic of the filter illustrated in FIG. 5 when a non-short-circuiting section has a width w of 0.7 mm.
Figure 8:
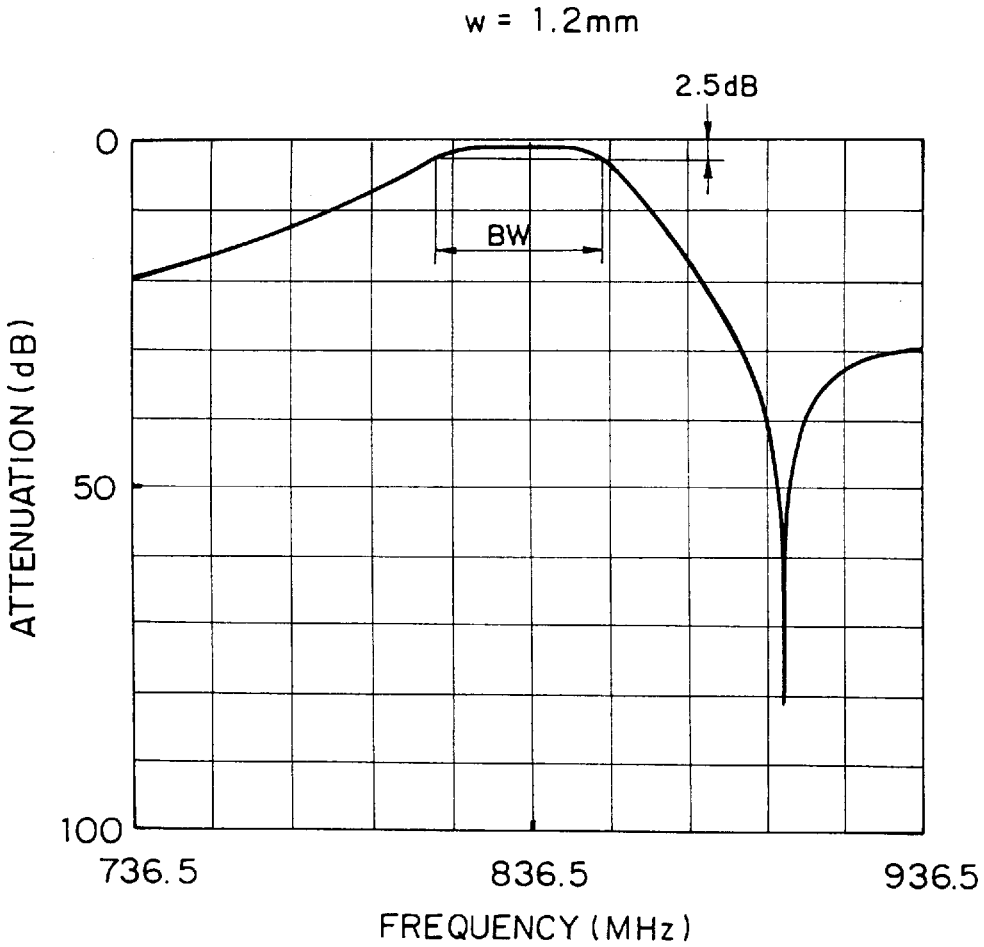
FIG. 8 is a graph showing a frequency characteristic of the filter illustrated in FIG. 5 when a non-short-circuiting section has a width w of 1.2 mm.

Further, it was found that the coupling effects become more and more conspicuous if the non-short-circuiting section 19 or 20 is extended in the direction paralle to the plane through the resonators. That is, in accordance with the filter arrangement illustrated in FIG. 5 there were prepared three filters which have the non-short-circuiting sections of different widths w set to 0.2 mm, 0.7 mm and 1.2 mm, respectively. FIGS. 6, 7 and 8 show frequency characteristics measured in these filters. As will be appreciated from the graphs in FIGS. 6–8, bandpass width BW at 2.5 dB is enlarged as the width w of the non-short-circuiting section 20 is increased.

Table 1 shows tansmission characteristics of the three filters prepared for the measurement.

TABLE 1

| Width w of Non-short-circuting section | Insertion loss | Attenuation (869–894 MHz) | Figure |
|---|---|---|---|
| 0.2 mm | 6.96 dB | 25.8 dB | FIG. 6 |
| 0.7 mm | 2.24 dB | 20.1 dB | FIG. 7 |
| 1.2 mm | 1.31 dB | 11.7 dB | FIG. 8 |
| Specification value | ≦2.5 | ≧17 | — |

As will noted in Table 1, when the width w of the non-short-circuiting section 20 is about 0.2 mm, the insertion loss become greater than the specification value. When the width w of the non-short-circuiting section 20 is about 1.2 mm, the attenuation value become less than the specification value. When the width w of the non-short-circuiting section 20 is approximately 0.7 mm, there were obtained satisfactory insertion lose and attenuation value which are comparable to the specification values, respectively.

In view of the coupling effect, therefore, it is desirable that the width w is as large as possible. However, in order to meet the requirement of the specification for an insertion loss and attenuation value or the like the width w should be set to the range of 0.2 mm<w<1.2 mm, preferably approximately 0.7 mm.

Figure 9:
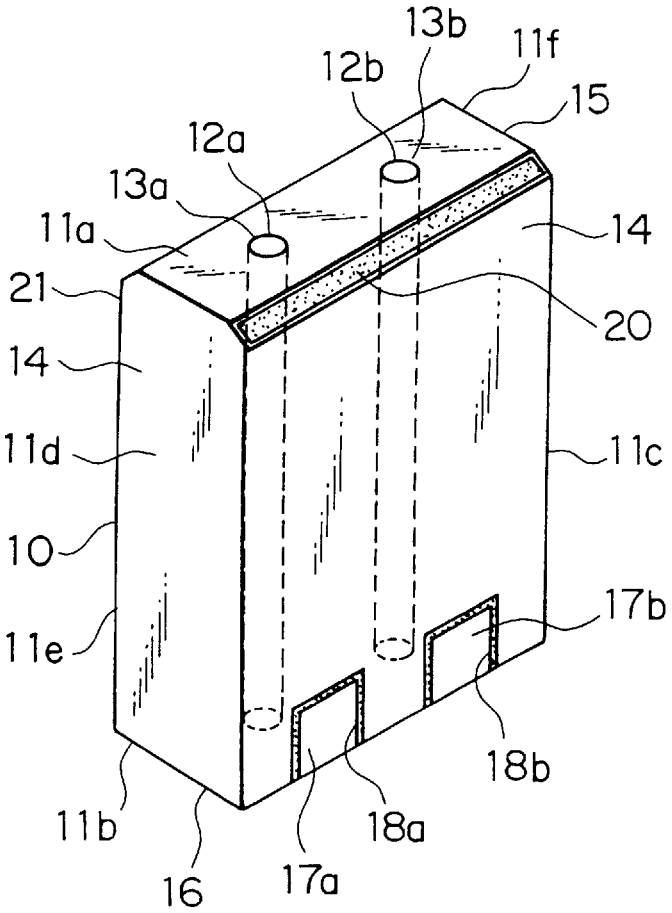
FIG. 9 in a schematic perspective view showing a modification of the two-stage dielectric filter illustrated in FIG. 5.

FIG. 9 illustrates a modification of the embodiment of FIG. 5, in which the components corresponding to the respective components of the dielectric filter of FIG. 5 are denoted respectively by the same reference symbols.

In the modified embodiment illustrated in FIG. 9 the short-circuiting side 15 of the dielectric block 10 is provided with two beveled sections 20 and 21 which are non-short-circuiting sections and are formed both edges of the top 11*a* of the dielectric block 10 extending in parallel to each other. These beveled sections 20 and 21 are formed before the short-circuiting conductor is formed on the top 11*a* of the dielectric block 10 or, alternatively at the time of producing the dielectric block 10 as in the case of the embodiment illustrated in FIG. 5.

While each of the above described embodiments is a two-stage type dielectric filter comprising a pair of dielectric coaxial resonators, a dielectric filter according to the invention may be a three-stage type dielectric filter comprising three dielectric coaxial resonators or a four- or more-stage type dielectric filter comprising four or more dielectric coaxial resonators.

While the embodiment illustrated in FIGS. 3 and 4 comprises a single non-short-circuiting section formed along one of the edges of the short-circuiting side 15 of the dielectric block 10 running in parallel with the direction of linking the resonators, it may alternatively comprise two non-short-circuiting sections formed along the respective edges of the short-circuiting sides 15 running in parallel with the direction of linking the resonators as in the embidiment illustrated in FIG. 9.

Additionally, the characteristic values (including the high frequency band width and the attenuation pole generating frequency) of a dielectric filter according to the invention can be regulated by controlling the area of the non-short-circuiting section or sections. More specifically, the characteristic values can be regulated easily by enlarging the area of the non-short-circuiting section or sections or, conversely, adding a piece of conductor to the non-short-circuiting section or sections.

As described above, according to the invention, there is provided a dielectric filter having a short-circuiting surface on which a coupling element can be precisely positioned without requiring any accurate patterning operation. Such dielectric filters can be manufactured easily on a mass production basis to provide a high yield even when the filter devices show positional displacements and/or dimensional deviations from the specified values. Additionally, a dielectric filter according to the invention is capable of providing a sufficient and controllable degree of coupling without reducing the Q value and the mechanical strength and meeting the requirement of height reduction and hence operates highly stably.

I claim:

1. A dielectric filter comprising a dielectric block provided with a plurality of through holes bored from one end surface all the way to the other end surface thereof and arranged in parallel with each other, each of the through holes having a peripheral wall coated with an inner conductor to form a dielectric coaxial resonator, an outer conductor arranged on a substantial portion of an outer peripheral surface of the dielectric block and a short-circuiting conductor arranged on the one end surface of the dielectric block and connecting the inner conductors on the peripheral walls of the through holes with the outer conductor on the outer peripheral surface to form a short-circuiting side, the other end surface of the dielectric block being formed as an open-circuiting side, wherein at least one non-short-circuiting section is provided on the short-circuiting side of the dielectric block, each of said at least one non-short-circuiting section is formed by a portion of the dielectric block pre-cut along at least one of the edges between the short-circuiting side and the outer peripheral surface running in parallel with the direction of linking the resonators and extends all the way between the opposite ends of the edge.

2. A dielectric filter according to claim 1, wherein said each non-short-circuiting section is formed as a stepped section.

3. A dielectric filter according to claim 1, wherein said each non-short-circuiting section is formed as a beveled section.

4. A dielectric filter according to claim 1, wherein said each non-short-circuiting section has a width w which is a range of 0.2 mm<w<1.2 mm, preferably about 0.7 mm.

5. A dielectric filter according to claim 1, wherein the filter has characteristic values which are regulated by controlling the area of said each non-short-circuiting section.

6. A dielectric filter according to claim 5, wherein the area of said each non-short-circuiting section is controlled by enlarging the area.

7. A dielectric filter according to claim 5, wherein the area of said each non-short-circuiting section is controlled by adding a piece of conductor to said each non-short-circuiting section.

* * * * *

UNITED STATES PATENT AND TRADEMARK OFFICE

CERTIFICATE OF CORRECTION

PATENT NO. : 5,859,575

DATED : January 12, 1999

INVENTOR(S) : Seigo Hino

It is certified that error appears in the above-indentified patent and that said Letters Patent is hereby corrected as shown below:

On the title page: Item [56]

FOREIGN PATENT OR PUBLISHED FOREIGN PATENT APPLICATION

| | | DOCUMENT NUMBER | | | | | | | PUBLICATION DATE | COUNTRY | CLASS | SUBCLASS | TRANSLATION | |
|---|---|---|---|---|---|---|---|---|---|---|---|---|---|---|
| | | | | | | | | | | | | | YES | NO |
| | 3 | - | 2 | 9 | 3 | 8 | 0 | 2 | 12/25/91 | Japan (with English language abstract) | | | | |
| | 8 | - | 8 | 6 | 0 | 7 | | | 01/12/96 | Japan (with English language abstract) | | | | |
| | | | | | | | | | | | | | | |

UNITED STATES PATENT AND TRADEMARK OFFICE

CERTIFICATE OF CORRECTION

PATENT NO. : 5,859,575

DATED : January 12, 1999

INVENTOR(S) : Seigo Hino

It is certified that error appears in the above-identified patent and that said Letters Patent is hereby corrected as shown below:

In the Claims:

Add the following new claims:

8. A dielectric filter comprising a dielectric block provided with a plurality of through holes bored from one end surface all the way to the other end surface thereof and arranged in parallel with each other, each of the through holes having a peripheral wall coated with an inner conductor to form a dielectric coaxial resonator, an outer conductor arranged on a substantial portion of an outer peripheral surface of the dielectric block and a short-circuiting conductor arranged on the one end surface of the dielectric block and connecting the inner conductors on the peripheral walls of the through holes with the outer conductor on the outer peripheral surface to form a short-circuiting side, the other end surface of the dielectric block being formed as an open-circuiting side, wherein at least one non-short-circuiting section is provided on the short circuiting side of the dielectric block, said at least one non-short-circuiting section is formed by cutting out a portion of the dielectric block along the outer peripheral surface running in paralle with the direction of linking the resonators and extends all the way between the opposite ends of the edge.

9. A dielectric filter according to claim 8, wherein said each non-short-circuiting section is formed as a stepped section.

UNITED STATES PATENT AND TRADEMARK OFFICE

CERTIFICATE OF CORRECTION

PATENT NO. : 5,859,575

DATED : January 12, 1999

INVENTOR(S) : Seigo Hino

It is certified that error appears in the above-identified patent and that said Letters Patent is hereby corrected as shown below:

10. A dielectric filter according to claim 8, wherein said each non-short-circuiting section is formed as a beveled section.

11. A dielectric filter according to claim 8, wherein said each non-short-circuiting has a width w which is a range of 0.2mm < w < 1.2mm, preferably about 0.7mm.s 12. A dielectric filter according to claim 8, wherein the filter has characteristic values which are regulated by controlling the area of said each non-short-circuiting section.

13. A dielectric filter according to claim 12, wherein the area of said each non-short-circuiting section is controlled by enlarging the area.

UNITED STATES PATENT AND TRADEMARK OFFICE

CERTIFICATE OF CORRECTION

PATENT NO. : 5,859,575

DATED : January 12, 1999

INVENTOR(S) : Seigo Hino

It is certified that error appears in the above-indentified patent and that said Letters Patent is hereby corrected as shown below:

14. A dielectric filter according to claim 12, wherein the area of said each non-short-circuiting section is controlled by adding a piece of conductor to said each non-short-circuiting section.

Signed and Sealed this

Ninth Day of November, 1999

*Attest:*

*Attesting Officer*

Q. TODD DICKINSON

*Acting Commissioner of Patents and Trademarks*